US010237963B2

(12) United States Patent
Konoplev et al.

(10) Patent No.: US 10,237,963 B2
(45) Date of Patent: Mar. 19, 2019

(54) RADIO FREQUENCY CAVITIES

(71) Applicant: Oxford University Innovation Limited, Oxford (GB)

(72) Inventors: Ivan Konoplev, Oxford (GB); Graeme Burt, Lancaster (GB)

(73) Assignee: Oxford University Innovation Limited, Oxford (GB)

( * ) Notice: Subject to any disclaimer, the term of this patent is extended or adjusted under 35 U.S.C. 154(b) by 8 days.

(21) Appl. No.: 15/529,398

(22) PCT Filed: Nov. 24, 2015

(86) PCT No.: PCT/GB2015/053565

§ 371 (c)(1),
(2) Date: May 24, 2017

(87) PCT Pub. No.: WO2016/083788

PCT Pub. Date: Jun. 2, 2016

(65) Prior Publication Data

US 2017/0273168 A1 Sep. 21, 2017

(30) Foreign Application Priority Data

Nov. 25, 2014 (GB) ..... 1420936.5

(51) Int. Cl.
*H05H 7/22* (2006.01)
*H05H 13/10* (2006.01)
*H05H 7/06* (2006.01)

(52) U.S. Cl.
CPC ..... *H05H 7/22* (2013.01); *H05H 7/06* (2013.01); *H05H 13/10* (2013.01); *H05H 2007/227* (2013.01)

(58) Field of Classification Search
None
See application file for complete search history.

(56) References Cited

U.S. PATENT DOCUMENTS 3,466,554 A * 9/1969 Giordano ..... H05H 9/04 313/359.1
3,514,662 A * 5/1970 Eldredge ..... H05H 9/04 174/1

(Continued)

FOREIGN PATENT DOCUMENTS

JP 11067498 3/1999
JP 2000200699 A 7/2000
WO WO2012061051 A2 5/2012

OTHER PUBLICATIONS

Gianluigi Clemente "The Room Temperature CH-DTL and its application for the FAIR Proton Injector", Jan. 1, 2007, http://linac.physik.uni-frankfurt.de/publikationen/doktor-clemente.pdf, p. 59-73.

(Continued)

*Primary Examiner* — Crystal L Hammond
(74) *Attorney, Agent, or Firm* — O'Shea Getz P.C.

(57) ABSTRACT

A radio-frequency (RF) cavity apparatus for accelerating charged particles includes first and second cavity arms. The first and second cavity arms have respective first and second axes of rotational symmetry and each cavity arm includes at least one cell. The first and second cavity arms are connected by a resonance coupler. The cell(s) of the first cavity arm have an axial dimensional parameter that is equal to a corresponding axial dimensional parameter of the cell(s) of the second cavity arm, and the cell(s) of the first cavity arm have at least one non-axial dimensional parameter that differs from corresponding non-axial dimensional parameter(s) of the cell(s) of the second cavity arm.

20 Claims, 7 Drawing Sheets

(56) References Cited

U.S. PATENT DOCUMENTS 4,004,181 A * 1/1977 Kervizic ..... H01J 23/20 315/5.41
4,323,857 A 4/1982 Brau et al.
4,479,218 A 10/1984 Brau et al.
5,280,252 A * 1/1994 Inoue ..... H05H 9/00 313/359.1
5,365,186 A * 11/1994 Ensley ..... H01J 25/00 330/4
5,412,283 A * 5/1995 Tronc ..... H05H 9/02 313/359.1
5,578,909 A * 11/1996 Billen ..... H05H 7/18 315/500
5,659,228 A * 8/1997 Ueda ..... H05H 7/04 315/5
5,929,567 A * 7/1999 Kang ..... H01J 23/213 315/5.39
6,332,017 B1 12/2001 Carroll et al.
7,339,320 B1 * 3/2008 Meddaugh ..... H05H 9/048 315/5.41
7,345,435 B1 * 3/2008 Sekutowicz ..... H05H 7/20 315/500
7,391,850 B2 6/2008 Kaertner et al.
7,499,476 B1 3/2009 Hutton
8,674,630 B1 * 3/2014 Cornelius ..... H05H 7/20 315/5.41
8,847,489 B2 * 9/2014 Teryaev ..... H01J 25/10 313/409
9,485,849 B1 * 11/2016 Vetter ..... H05H 7/22
9,786,464 B2 * 10/2017 Lunin ..... H01J 23/20
2002/0122531 A1 * 9/2002 Whitham ..... H05H 9/04 378/137
2002/0158575 A1 * 10/2002 Bertsche ..... H05H 7/18 313/505
2003/0030391 A1 * 2/2003 Hanna ..... H05H 7/18 315/505
2003/0146704 A1 * 8/2003 Ding ..... H05H 7/18 315/5.41
2004/0057554 A1 * 3/2004 Bjorkholm ..... G01V 5/0016 378/143
2004/0108823 A1 * 6/2004 Amaldi ..... H05H 7/22 315/505
2004/0228445 A1 11/2004 Kucharczyk
2005/0213708 A1 9/2005 Lawrence et al.
2005/0260951 A1 * 11/2005 Joshi ..... H01P 7/06 455/77
2006/0102622 A1 * 5/2006 Gregoire ..... H05B 6/70 219/695
2006/0244448 A1 * 11/2006 Ballon ..... G01R 33/34046 324/318
2006/0251217 A1 11/2006 Kaertner et al.
2007/0035260 A1 * 2/2007 Ho ..... H05H 7/18 315/505
2007/0120508 A1 * 5/2007 Hanna ..... H05H 7/18 315/505
2007/0215813 A1 * 9/2007 Whittum ..... H01J 23/34 250/396 R
2007/0222542 A1 * 9/2007 Joannopoulos ..... B60L 11/182 333/219
2008/0164418 A1 7/2008 Shahar et al.
2009/0065701 A1 3/2009 Bale et al.
2009/0074145 A1 3/2009 Vadari et al.
2009/0302785 A1 * 12/2009 Miller ..... H05H 7/22 315/505
2010/0027753 A1 2/2010 Venugpal et al.
2010/0060208 A1 * 3/2010 Swenson ..... H05H 7/02 315/505
2010/0080356 A1 4/2010 Ishida et al.
2010/0284517 A1 11/2010 Paturi et al.
2010/0284518 A1 11/2010 Ahlawat et al.
2011/0013757 A1 * 1/2011 Kumar ..... G06F 21/54 379/93.05
2012/0194104 A1 * 8/2012 Heid ..... H05H 7/18 315/501
2012/0235602 A1 * 9/2012 Allen ..... H05H 7/18 315/505
2013/0083880 A1 4/2013 Noonan et al.
2014/0299782 A1 * 10/2014 Seryi ..... H05G 2/00 250/393
2015/0366046 A1 * 12/2015 Wang ..... H05H 9/044 315/504
2017/0006695 A1 * 1/2017 Jain ..... H05H 7/20

OTHER PUBLICATIONS

Wang, "Conceptual design considerations of a 5-cell dual-axis SRF cavity for ERLs" SRF Workshop 2007, Jan. 1, 2007, pp. 641-645.
Noguchi et al. "Multi-Beam Accelerating Structures", 2003 Workshop on RF Superconductivity, Sep. 1, 2010.
Wang et al. "Dual-axis energy recovery linac", 41st Advanced ICFA Beam Dynamics Workshop on Energy Recovery Linacs, vol. 125, Nov. 1, 2008, p. 122.
Warren et al. "Recent results from the Los Alamos free electron laser", Nuclear Instrumens and Methods in Physics Research A259 (1987) 8-12.
Ryoicha Hajima "Energy Recovery Linacs for Light Sources", Review of Accelerator Science and Technology vol. 3 (2010) 1-26.
Spalek et al. "The free-electron laser variable bridge coupler", IEEE Transactions on Nuclear Science, vol. NS-32, No. 5, Oct. 1985.
Kazuhisa Nakajima, "Towards a table-top free-electron laser", Nature Physics vol. 4 (2008), pp. 92-93.
Feldman et al. "The Los Alamos Free-Electron Laser Energy-Recovery Experiment", Proceedings of the 1987 Particle Accelerator Conference, p. 221.
Isidoro E. Campisi, "State of the Art Power Couplers for Superconducting RF Cavities", Jun. 4, 2002.
David E. Moncton "Inverse Compton Scattering: A Small Revolution in X-Ray Sources and Applications", May 16, 2006.
Wolf-Dietrich Moller, "High Power Coupler for the European XFEL", 5th Mac Meeting May 31, 2005.
Alice—"Accelerators and lasers in combined experiments", Compton Backscattering Experiment, May 16, 2001, http://alic.stfc.ac.uk/projects/CBS/index.html.
Lyncean Technologies Inc., "Science and Technology", Apr. 12, 2011, http://www.lyncheantech.com/ci_tech.html.
Aune et al. "Superconducting TESLA Cavities", Phy. Rev. ST-AB 3 032001 (2000).
"Research plans toward SRF ERL system for source of THz/X-ray radiation—UH-FLUX project" slides, presented Jul. 14, 2014.

* cited by examiner

--Prior Art—

RADIO FREQUENCY CAVITIES

This application is entitled to the benefit of, and incorporates by reference essential subject matter disclosed in PCT Application No. PCT/GB2015/053565 filed on Nov. 24, 2015, which claims priority to Great Britain Application No. 1420936.5 filed Nov. 25, 2014.

BACKGROUND OF THE INVENTION

1. Technical Field

The present invention relates generally to apparatus and methods for accelerating charged particles in a radio-frequency (RF) cavity. In embodiments of the present invention, a radio-frequency (RF) cavity apparatus may be used to accelerate electrons for various applications, including generation of X-rays and Terahertz radiation.

2. Background Information

Conventional methods of accelerating particles, e.g. electrons for X-ray generation, use a linear particle accelerator to accelerate the particles to energies of several keV or several MeV. In typical electron accelerators, a conventional injector emits an electron beam that is accelerated towards a target (interaction point), where electromagnetic radiation of different spectra is generated by different means. After that, the electron beam is dumped on a collector where X-ray radiation is generated upon impact via bremsstrahlung. Soft X-rays having energies of 0.12 to 12 keV and wavelengths of 10 to 0.1 nm can be generated in this way at either the interaction point or the collector. In more recent times linear accelerators such as the Stanford Linear Accelerator Center (SLAC) typically achieve electron energies around 3 GeV by using radio frequency (RF) fields to progressively accelerate an electron beam as it passes through a accelerating structure containing segmented RF cavities. Such high energy electron beams can be circulated in a storage ring using synchronized electric and magnetic fields and used, for example, to provide a source of synchrotron radiation including X-rays. These extremely bright (i.e. high flux) X-rays can be used to investigate molecular structures, resulting in many bio-medical applications such as protein crystallography.

While light sources such as the one at SLAC and the Diamond light source in the UK can provide researchers with very hard and bright X-rays for experimental studies, such facilities are extremely large, costly to run and not readily available to everyone. The Diamond light source is housed in a toroidal building that is 738 m in circumference and covers an area in excess of 43,300 $m^2$. Although the X-rays from a synchrotron source can be a billion times brighter than those, for example, generated by cathode ray tubes for normal medical imaging, a synchrotron source converts only a tiny fraction of the energy of the electrons into radiation. Furthermore the natural synchrotron light is not monochromatic and its application, for example, to phase-contrast imaging may require the use of sophisticated insertion devices and other techniques. Alternative X-ray sources, and particle accelerators generally, are required that can meet academic and industry demands on a more accessible scale.

One alternative to synchrotron light sources is a linear accelerator (linac)-based coherent light source such as the Linac Coherent Light Source (LCLS) at SLAC. This facility couples a linear particle accelerator with a free electron laser (FEL) to produce intense X-rays. In a free electron laser the electron beam itself is used as the lasing medium. The electron beam from the linac is injected into an undulator or "wiggler"—an array of magnets arranged with alternating poles along the light beam interaction path to slightly wiggle the electron beam transversely and stimulate the emission of coherent electromagnetic radiation in the form of X-rays. FEL radiation is monochromatic and extremely bright—the process of self-amplified spontaneous emission extracting a much greater fraction of the electrons' energy than can synchrotron radiation. In fact FEL X-ray sources can be many orders of magnitude brighter than synchrotron light sources.

Some researchers have demonstrated energy recovery in conjunction with a free electron laser by decelerating the electron beam after it has passed through a wiggler. The ALICE accelerator at Daresbury Laboratory in the UK has coupled an energy recovery linac to the undulator of a free electron laser generating light in the mid-IR range. In such a proposal the spent electron beam is returned back to the entrance of the main linac via an additional beam path at a precise time when the RF phase is exactly opposite to the initial accelerating phase such that the beam is decelerated and energy can be recovered back to the electromagnetic field inside the linac RF cavities. This energy recovery technique requires an accurate adjustment of the electron beam path length that is accomplished by moving the arc of the beam path as a whole.

While accelerators such as the LCLS at SLAC and ALICE at Daresbury Laboratory have demonstrated the potential of FELs as light sources, there are several drawbacks. Such facilities are extremely large—the LCLS based on a linear accelerator at SLAC, for example, is over 3 km long in total and includes a 600 m linac, 230 m electron beam transport tunnel, 170 m undulator and over 300 m of tunnels to transport X-rays to experimental halls. The overall billion dollar-scale cost and huge size of such machines means that they can only be constructed at a national level. There remains a need for smaller research bodies to have access to their own accelerators and smaller scale sources of THz radiation or X-rays.

Researchers at MIT have recently proposed an alternative X-ray source that is potentially smaller than the LCLS or other sources based on the principle of a free electron laser. This alternative technique uses inverse—Compton scattering to generate X-rays when an electron beam is collided with photons e.g. from a laser beam. U.S. Pat. No. 7,391,850 describes such a laboratory scale X-ray source.

WO 2012/061051 describes an X-ray generation apparatus utilizing energy recuperation to improve X-ray generation efficiency. The apparatus generates X-rays by accelerating a beam of electrons using a first RF cavity arrangement and then interacting the electrons with photons to generate X-rays via inverse—Compton scattering. After the interaction with the photons, the electrons are decelerated in a second RF cavity arrangement. The first and second RF cavity arrangements are connected by RF energy transmission means arranged to recover RF energy from the decelerating electrons as they pass through the second cavity arrangement and then to transfer the recovered RF energy to the first cavity arrangement. The apparatus thereby provides an improvement over existing X-ray generation methods as the recuperation of the RF energy improves the efficiency of the X-ray generation.

There remains a need for compact sources that can efficiently generate high energy and high flux X-rays or other radiation for use in a wide range of experiments, in particular to extend the range of experiments that can be conducted using such compact sources. In addition, there remains a need more generally for compact particle accelerators that benefit from using energy recovery and can achieve high operating currents.

SUMMARY OF THE INVENTION

According to a first aspect of the invention, there is provided a radio-frequency (RF) cavity apparatus for accelerating charged particles, comprising first and second cavity arms, the first and second cavity arms having respective first and second axes of rotational symmetry and each cavity arm comprising at least one cell, wherein the first and second cavity arms are connected by a resonance coupler, wherein the cell(s) of the first cavity arm have an axial dimensional parameter that is equal to a corresponding axial dimensional parameter of the cell(s) of the second cavity arm, and wherein the cell(s) of the first cavity arm have at least one non-axial dimensional parameter that differs from corresponding non-axial dimensional parameter(s) of the cell(s) of the second cavity arm.

The Applicant has appreciated that having at least one non-axial dimensional parameter that differs between the cells of the first cavity arm and the second cavity arm results in a difference in boundary conditions for the cavity arms, and consequently a difference in the higher order resonant mode spectra of the cell(s) of each cavity arm. At the same time, having an axial parameter that is the same for the cells of the first and second cavity arms results in the first and second cavity arms sharing a fundamental mode. The Applicant has appreciated that having a shared fundamental mode, but different higher order modes, advantageously improves the stability of a charged particle (e.g. electron) bunch that is accelerated or decelerated along an axis of a cavity arm when a resonance coupler is connected between the two arms to ensure resonant coupling of eigenmodes of the same frequency. This is explained further below.

In a two-arm cavity apparatus in which the cells of each arm are identical, the cells of each arm share not only the same fundamental mode but also the same higher order modes. The electric field of the fundamental mode typically is strongest near the axis of a cell, and is directed along the axis. In contrast, higher order modes (e.g. dipole, quadrupole) may be directed at least partly transverse to the axis and/or may be stronger away from the axis than on the axis. The result is that as a charged particle bunch is accelerated along an axis of a cavity arm (the "accelerating arm"), the higher order modes (sometimes referred to as "parasitic modes") may cause the charged particle bunch to be accelerated in a direction having a component transverse to the axis, deflecting the path of the charged particle bunch. If a charged particle bunch is deflected too much, it may break up i.e. get dumped on the cell walls instead of proceeding to a collector.

However, even a small deflection that does not cause the bunch to break up can be problematic. This is because when the charged particle bunch reaches the other cavity arm (the "decelerating arm") where it will be decelerated, its path will have deviated from the axis of the cavity arm. As the charged particles are not moving along the axis, when the charged particles are decelerated, a significant amount of the energy from the charged particles will be transferred to a higher order mode rather than to the fundamental mode. As a result, the electric field strength of the higher order mode in the accelerating cavity arm will be increased because the arms (and therefore the RF modes) are coupled. Consequently, subsequent charged particle bunches being accelerated will experience greater deflecting forces from that higher order mode, causing a greater deviation in their path from the axis. This can result in a feedback mechanism in which the deflection of subsequent bunches becomes increasingly large as the deflected bunches feed energy into the higher order modes. In this way, the higher order modes can cause the break-up of charged particle bunches.

According to the present invention, the difference in boundary conditions of the cells of the first cavity arm and the second cavity arm results in different higher order mode spectra for each cavity arm. Accordingly, the resonance coupler can couple the arms strongly at common resonance frequencies, while coupling at resonance frequencies which are not shared by both arms can be small, e.g. negligibly small. Accordingly, if a charged particle bunch in the accelerating cavity arm (e.g. the first cavity arm) is deflected slightly by a higher order mode, and subsequently in the decelerating cavity arm (e.g. the second cavity arm) feeds energy to a higher order mode, this will not result in a feedback mechanism e.g. associated with accumulation of high order modes. This is because a higher order mode of the decelerating cavity arm that gains energy is not coupled (or is only very weakly coupled) to a corresponding higher order mode in the accelerating cavity arm.

The resonance coupler may be any suitable structure that can share or recover radio frequency energy between the arms. Preferably the resonance coupler only strongly couples modes having the same or overlapping frequencies.

In a symmetric cavity apparatus, a larger charged particle bunch would result in a larger amount of energy being fed into the higher order mode(s) of the decelerating cavity arm, increasing the effect of the feedback mechanism. As such, there is a limit to how much charge can be accelerated without causing sufficient feedback to break up the charged particle bunch. This is known as "beam break-up" instability. Where the cavity is used, for example, as a radiation source, the break-up of charged particle bunches will result in the source ceasing to function. The parasitic modes therefore limit the operating current of such a source, and therefore limits the brightness of the generated X-ray beam or other radiation.

The removal or suppression of this feedback mechanism in the present cavity apparatus allows larger charged particle bunches to be accelerated, and thus higher operating currents to be used.

This has many benefits that will be evident to a person skilled in the art, for example, permitting experiments requiring very bright X-ray beams to be carried out using a relatively small scale X-ray generator, whereas otherwise it might be necessary to use large scale facilities, such as SLAC or the Diamond Light Source. It will also be appreciated that higher operating currents are beneficial in many other applications using particle accelerators as a radiation source or otherwise.

As specified above, the invention provides that the cell(s) of the first cavity arm have an axial dimensional parameter that is equal to a corresponding axial dimensional parameter of the cell(s) of the second cavity arm. It is known in the art that the dimensional parameters of a radio-frequency cavity will determine the fundamental and higher order modes that are supported by the cavity, i.e. the resonant frequencies of the cavity. In particular, the wavelength (and therefore the frequency) of the fundamental mode will be determined by the axial dimension(s) of the cells. Therefore, in the arms of the cavity apparatus, each cell will behave as a radio-frequency cavity having certain resonant modes, and the wavelength, and therefore frequency, of the fundamental mode will be determined by an axial dimensional parameter of each cell. As the cell(s) of the first cavity arm each have an axial dimensional parameter that is equal to a corresponding parameter of the cell(s) of the second cavity arm, the cells of the first and second cavity arms will support the same fundamental mode. This may be referred to as the operating mode of the RF cavity apparatus.

Preferably the axial dimensional parameter is the length of each cell. However, the axial dimensional parameter could be any suitable parameter that affects the frequency of the fundamental mode. Preferably each cell supports a fundamental radio-frequency mode, and preferably the fundamental radio-frequency mode is an accelerating (or decelerating) mode. An accelerating (or decelerating) mode is a mode that provides an electric field in a cell in the region of propagation of charged particles during use, where the electric field is directed substantially parallel to the charged particle velocity. Typically, the velocity of charged particles would be along the respective axes of rotational symmetry of the first and second cavity arms. Such an accelerating/decelerating mode would cause the acceleration or deceleration of charged particles in the direction of the first or second axis. It will be appreciated that in a cavity apparatus having one accelerating arm and one decelerating arm, either the first or the second cavity arm could be the accelerating arm.

The non-axial parameter could be any suitable parameter that would result in the cell(s) of the first and second cavity arms having different higher order mode spectra. As non-limiting examples, the non-axial parameter could be a maximum width or radius of a cell, a minimum width or radius of a cell, a curvature of a cell wall, e.g. a difference in variation of the radius in the axial direction, or any other suitable dimensional parameter. In some embodiments there may be only one non-axial dimensional parameter that differs between the cell(s) of the first and second cavity arms. In other embodiments, there may be more than one, e.g. two, three, four or more non-axial dimensional parameters that differ between the cell(s) of the first and second cavity arms.

In one preferred embodiment, the non-axial dimensional parameters that differ are one or more of the major and minor axes of ellipses, where the ellipses correspond to portions of the cavity wall along an axial cross-section of a cell. For example, a first ellipse may correspond to the shape of a cavity wall (when viewed in longitudinal cross-section) near a region of a cell corresponding to a maximum radius, and a second ellipse may correspond to the shape of a cell wall in a region of a minimum radius of a cell (i.e. near the narrowest portion of the cell where the cell may be joined to an adjacent cell).

The shape and dimensions of the cell(s) of the cavity arms must be selected such that the cells are capable of supporting the required resonant modes under operation of the cavity. Any significant deviation in the shape and or dimensions of the cell(s) of the cavity alms may prevent operation of the cavity apparatus, i.e. the cells may become incapable of supporting standing modes or may be incapable of supporting the required operating mode(s) (e.g. the fundamental mode). The difference between the non-axial dimensional parameters of the cells of the first and second cavity arms must be chosen such that they are not detrimental to the operation of the cavity. Too great a difference may prevent operation of the cavity apparatus. Conversely, the difference must be sufficiently large to produce a desired difference in the parasitic modes of the cell(s) of each cavity arm.

Accordingly, a balance may be struck between a difference that is sufficiently large to produce the desired difference in the higher order mode spectra and a difference that is sufficiently small so as not to hinder the operation of the cavity apparatus. In preferred embodiments, the difference between the or each of the non-axial dimensional parameters of the cell(s) of the first cavity arm and the corresponding non-axial dimensional parameter of the cell(s) of the second cavity arm, expressed as a percentage of the former, is less than about 5%, less than about 3%, less than about 1%, or less than about 0.5%. Where more than one non-axial parameter differs between the first and second cavity arms, the respective difference in each of the parameters may be the same percentage, but in preferred embodiments the respective percentage differences of each parameter are different. As a non-limiting, illustrative example, a first non-axial dimensional parameter may differ between the first and second cavity arms by approximately 2%, while a second non-dimensional axial parameter has a difference of 1%, and a further parameter may have a difference of 0.5%.

The difference may be relative to a conventional, optimum configuration of one cavity arm. For example, one of the cavity arms may be provided with a known configuration i.e. having non-axial parameter values known or commonly used in the art, where the other cavity arm is a deviation of this conventional configuration. Alternatively, each cavity arm may be a deviation from a known conventional configuration. For example, each non-axial parameter of the cells of the cavity arms may be above a conventional value for one of the arms and below a conventional value for the other arm.

In some embodiments, each of the first and second cavity arms may comprise exactly one operating cell, which may be in addition to coupling cells or end cells of the cavity arms. However, in preferred embodiments each of the first and second cavity arms comprises more than one operating cell, for example, each cavity arm may comprise two, three, four, five or more operating cells. Preferably the first and second cavity arms each comprise the same number of operating cells. In preferred embodiments, the axial and non-axial parameters discussed above, including the examples and properties of examples and the possible ranges, apply to each operating cell (or each of a group of cells) in the first and second cavity arms, e.g. operating cells in the same arm may have the same values of the non-axial parameters as each other, but operating cells in different arms may have different values. As mentioned, this may apply instead to each operating cell of a group of cells of a cavity arm. For example, the cavity arm may comprise a number of operating "middle" cells in addition to an end cell and a coupling cell. In such a case, each of the middle cells of, for example, the first cavity arm may have the same value for any given parameter, and similarly each of the middle cells of the second cavity arm may have the same value for a particular parameter.

Preferably the axial dimensional parameter value of the cell(s) of the first and second cavity arms is selected such that the fundamental mode in the range of about 100 MHz-10 GHz, or about 500 MHz-5 GHz, or about 1-2.5 GHz, e.g. about 1.3 GHz. Preferably the values of the non-axial dimensional parameter(s) are selected to achieve a frequency separation of the order of few MHz between corresponding higher order modes of the cells of the first and second cavity arms.

A radio-frequency cavity apparatus according to embodiments of the present invention has various applications, with corresponding configurations, but in preferred embodiments, the cavity apparatus is configured to accelerate charged particles along the axis of one of the cavity arms, and to decelerate a beam of charged particles along the axis of the other cavity arm. Accordingly, in preferred embodiments, the apparatus comprises a charged particle beam generator for generating a beam of charged particles. Preferably, the cell(s) of one of the cavity arms are arranged to apply an RF electric field to accelerate a charged particle beam from the generator. Preferably the cells of the other cavity arm are arranged to apply an RF electric field to decelerate a charged particle beam. Preferably the charged particle beam decelerated in the first (or second) cavity arm is the same charged particle beam that is accelerated in the second (or first) cavity arm.

In embodiments where a charged particle beam is accelerated in one of the cavity arms and a charged particle beam, which may be the same beam, is subsequently decelerated in the other cavity arm, energy recovery is possible using the resonant coupler. For example, the second (or first) cavity arm may accelerate the charged particle beam to a suitably high energy for a purpose as may be desired. For example, the charged particles may be used to interact with other particles, or photons, or a sample, e.g. as part of an experiment. Once the high energy charged particles have been used, rather than wasting the energy of the charged particles, this energy can be at least partially recovered via the subsequent deceleration of the charged particle beam in the first (or second) cavity arm. Preferably the resonance coupler is arranged to recover RF energy from the decelerated charged particle beam as it passes through the first cavity arm and to transfer the recovered RF energy into the second cavity arm, or vice versa.

Preferably, the resonance coupler comprises one or more RF waveguides or coupling cells connecting the first and second cavity arms. In embodiments in which the first and second cavity arms comprise more than one cell, the cells of each cavity arm may be arranged in series, and each cell of the first cavity arm may be coupled to a corresponding cell of the second cavity arm by a respective waveguide. However, preferably a single coupling cell is provided which is connected to one end of each of the cavity arms.

Preferably, the resonance coupler is configured to strongly couple eigenmodes which have the same frequencies and to weakly couple eigenmodes which have different frequencies.

Where a single coupling cell is provided, the single coupling cell is preferably racetrack or oblong-shaped. The coupling cell preferably comprises two openings for joining the coupling cell to a cell of each of the first and second cavity arms. Preferably the coupling cell exhibits reflectional symmetric in a plane that transversely-bisects the coupling cell, with the exception that the two opening may be of different sizes to accommodate the different sizes of the cells of the first and second cavity arms joined to the coupling cell.

The Applicant has appreciated that this configuration of the coupling cell provides a further advantage, which is that the coupling cell strongly (i.e. resonantly) couples the fundamental (accelerating or decelerating) mode between the two cavity arms, but only weakly couples higher order modes which are not shared by the two cavity arms. This enhances the advantage provided by the difference in the parasitic mode spectra of the cavity arms. The difference in the frequencies of the higher order modes provides some suppression/selection of the higher order mode coupling/feedback; the closer the modes are in frequency, the larger the overlap between them and more strongly they will couple. If the modes are separated well there is no leakage of electromagnetic energy between the cavity arms at these frequencies associated with well separated modes. The coupling cell configuration suppresses the higher order mode coupling/feedback even further.

In some preferred embodiments, the cell(s) of the first and second cavity arms are formed from, or coated with, super-conducting material(s). The resonance coupler may comprise waveguide(s) or cell(s) formed from, or coated with super-conducting material(s). The super-conducting cells and the super-conducting waveguide(s) or coupling cell(s) may be integrally formed or connected together.

The super-conducting cells may be provided in a cryostat. The super-conducting waveguide(s) or coupling cell(s) may also be provided in a cryostat. Preferably the super-conducting cells and the super-conducting waveguide(s) or coupling cell(s) are provided in the same cryostat. This may help to make the apparatus more compact. Where provided, the charged particle beam generator may also be provided in the cryostat. The charged particle beam generator may be integrally formed with one or more of the super-conducting cells of one of the cavity arms.

In preferred embodiments, the axes of the first and second cavity arms are substantially parallel. Each cavity arm preferably comprises more than one cell, and preferably the cells of each arms share an axis of rotational symmetry. Preferably each cell has an axial cell length of $\lambda/2$, where $\lambda$ is the wavelength of the accelerating or decelerating mode. Preferably the coupling cell has a longitudinal axis that is perpendicular to the axes of the first and second cavity arms.

The charged particle beam may comprise one or more of: electrons, positrons, protons or ions. In preferred embodiments, the charged particle beam is an electron beam. In preferred embodiments in which the charged particles are electrons, the electron beam preferably comprises bunches of electrons. In some preferred embodiments, energy is extracted from an accelerated electron beam through an interaction process.

The interaction process may comprise one or more of: interacting the electron beam with photons to generate X-rays via inverse Compton scattering; passing the electron beam through an undulator or applying an alternating magnetic field to generate electro-magnetic radiation; directing the electron beam onto a target to cause emission and/or fluorescence; and interacting the electron beam directly with a sample for electron diffractometry or microscopy. In various examples, the electron beam may be used in the generation of Terahertz radiation or X-rays.

The apparatus may comprise means arranged to turn the charged particle beam substantially through 180° between the first cavity arm and the second cavity arm. This allows the particle beam that is accelerated in the second cavity arm to be directed to the first cavity arm for deceleration (or vice versa) and energy recuperation after it has been used, e.g. in an interaction process.

The apparatus may further comprise a photon source. The photon source may be arranged to provide photons to interact with the charged particle beam as the accelerated charged particle beam turns through an angle of about 90° after passing out of one of the cavity arms and before entering the other arm.

According to a second aspect of the invention, there is provided a method of recovering energy from a charged particle beam comprising the steps of: generating a charged particle beam; passing the charged particle beam through a first cavity arm of a radio-frequency (RF) cavity apparatus, the first cavity arm being arranged to apply an electric and/or magnetic field to accelerate the charged particle beam; passing the charged particle beam through a second cavity arm of the radio-frequency (RF) cavity apparatus, the second cavity arm being arranged to apply an electric and/or magnetic field to decelerate the charged particle beam after it has interacted; wherein the first and second cavity arms are connected by a resonance coupler, wherein the cell(s) of the first cavity arm have an axial dimensional parameter that is equal to a corresponding axial dimensional parameter of the cell(s) of the second cavity arm, and wherein the cell(s) of the first cavity arm have at least one non-axial dimensional parameter that differs from corresponding non-axial dimensional parameter(s) of the cell(s) of the second cavity arm.

The features of the RF cavity apparatus of the first aspect are also applicable to the RF cavity apparatus of the second aspect.

BRIEF DESCRIPTION OF THE DRAWINGS

Certain preferred embodiments will now be described, by way of example only, with reference to the accompanying drawings, in which.

DETAILED DESCRIPTION OF THE INVENTION

Figure 1:
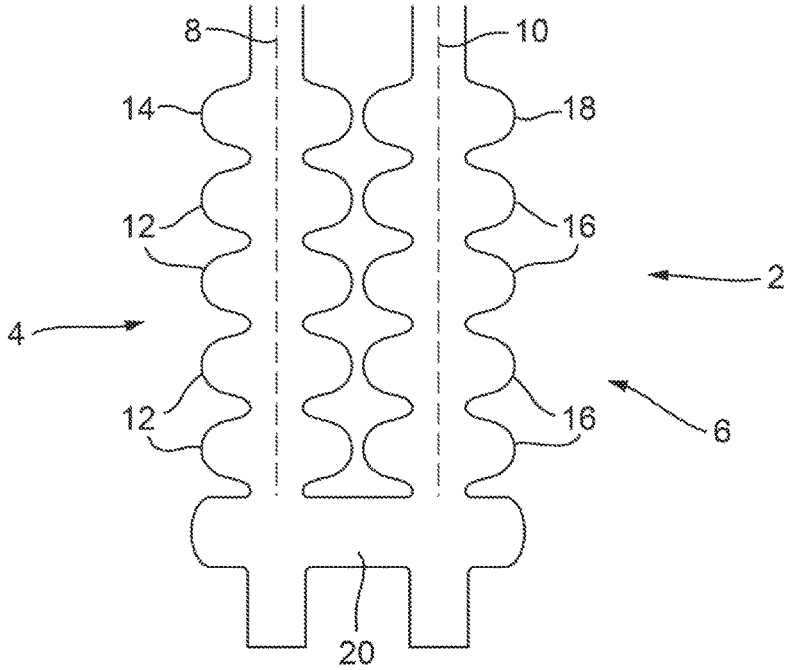
FIG. 1 shows an outline of a cross-section of a cavity apparatus according to the prior art.

FIG. 1 shows a cavity apparatus 2 according to the prior art. The cavity apparatus 2 comprises a first cavity arm 4 and a second cavity arm 6. The first and second cavity arms 4, 6 have respective first and second axes of rotation 8, 10. The first and second cavity arms 4, 6 are arranged side by side with their respective axes 8, 10 parallel. The first cavity arm 4 comprises mid-cells 12 and an end cell 14. Similarly, the second cavity arm 6 comprises mid-cells 16 and an end cell 18. The first and second arms 4, 6 are joined by a coupling cell 20. The mid-cells 12 of the first cavity arm 4 have identical shape and dimensions to the corresponding mid-cells 16 of the second cavity arm 6. Similarly the end cell 14 of the second cavity arm 4 has identical shape and dimensions to end cell 18 of the second cavity arm 6.

Figure 2:
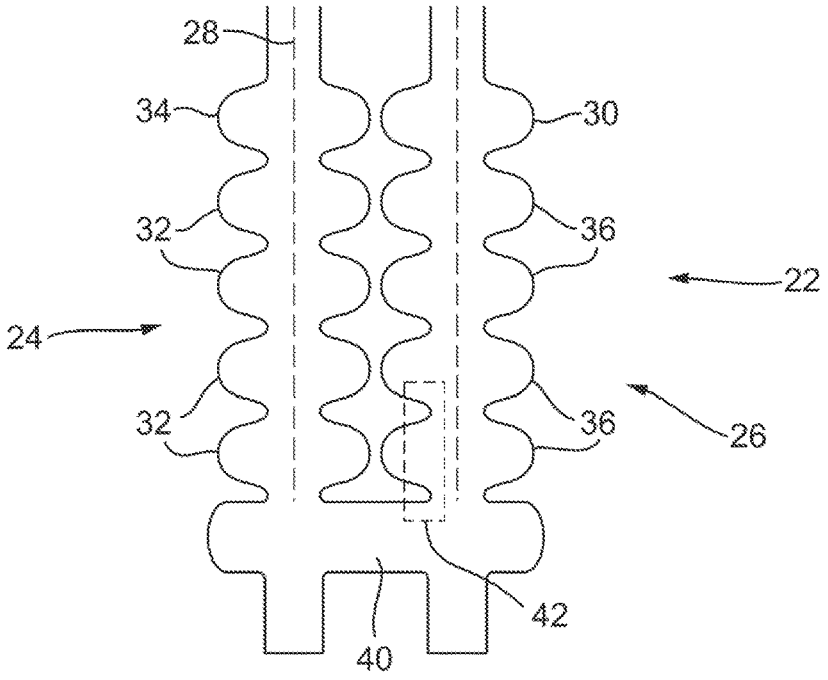
FIG. 2 shows an outline of a cross-section of a cavity apparatus in accordance with an embodiment of the present invention.

FIG. 2 shows a cavity apparatus 22 in accordance with an embodiment of the present invention. The cavity apparatus 22 comprises a first cavity arm 24 and a second cavity arm 26. Similarly to the cavity apparatus 2 of FIG. 1, the first cavity arm 24 has an axis of rotational symmetry 28, and comprises mid-cells 32 and an end cell 34. Similarly the second cavity arm 26 has an axis of rotational symmetry 30 and comprises mid-cells 36 and an end cell 38. The first and second cavity arms 24, 2 are joined by a coupling cell 40.

In contrast with the cavity apparatus 2 of FIG. 1, in the cavity apparatus 22 of FIG. 2, the mid-cells 32 of the first cavity arm 24 do not have identical shape and dimensions to the mid-cells 36 of the second cavity arm 26. Similarly, the end cell 34 of the first cavity arm 24 does not have identical shape and dimensions to the end cell 38 of the second cavity arm 26. The difference in shape and dimension is relatively small, but is most evident in the curvature of the arms at their narrowest points, as indicated by the dotted box 42 shown in FIG. 2.

Figure 3:
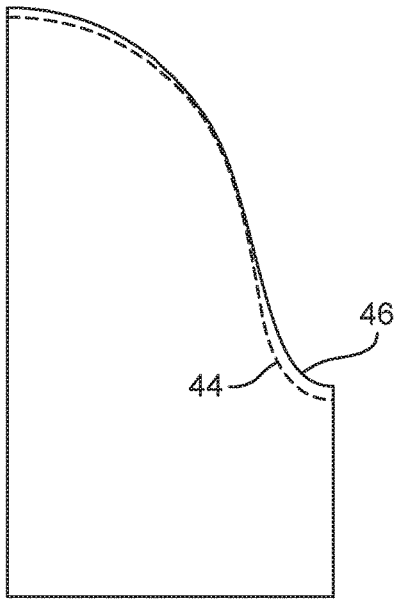
FIG. 3 shows a side view of a quadrant of a mid-cell from a first cavity arm of the apparatus of FIG. 2 (dotted line) overlaid on a corresponding quadrant of a mid-cell of a second cavity arm (solid line).

The small difference in the curvature of the mid-cells 32 of the first cavity arm 24 and the mid-cells 36 of the second cavity arm 26 is visible in FIG. 3, which shows a quadrant 44 (dashed line) of a mid-cell 32 of the first cavity arm 24, which is overlaid in a corresponding quadrant 46 (solid line) of a mid-cell 36 of the second cavity arm 26. This difference in curvature is characterized by a number of non-axial dimensional parameters, namely the major and minor ellipses that define the shape of portions of the cells walls, as described below with reference to FIG. 5.

Figure 4:
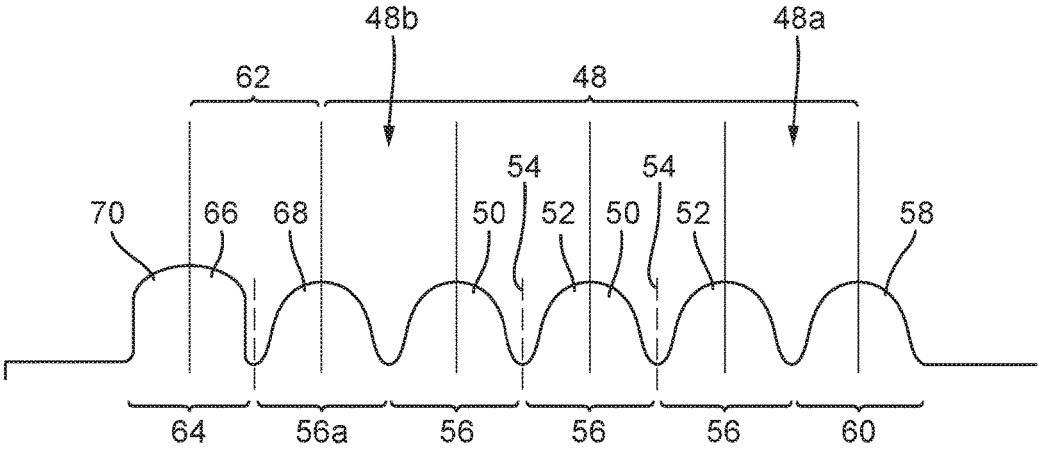
FIG. 4 shows an outline profile of one side of the second cavity arm of the apparatus shown in FIG. 2.

FIG. 4 shows a profile of one side of the second cavity all 126 of FIG. 2. FIG. 4 shows the division of the cells into cell pieces according to the manufacture of the cavity arm 26. The cavity arm 26 is produced from multiple mid-cell pieces 48. Each mid-cell piece 48 comprises a left side 50 and a right side 52 which are symmetric about a plane of reflectional symmetry 54. The left part 50 of each mid-cell piece joins to the right part 52 of the adjacent mid-cell piece to form a mid-cell 56. The exceptions are the mid-cell piece 48*a* (which is adjacent to an end cell piece 58, and forms part of the end cell 60) and the mid-cell piece 48*b* (which is adjacent to a mid-to-coupling section 62, and which forms part of the mid-cell 56*a* adjacent to coupling cell 64).

The mid-to-coupling section 62 comprises two parts: the coupling cell piece 66 and the mid-to-coupling cell piece 68. The coupling cell piece 66 of the mid-to-coupling section 62 has shape and dimensions as described further below with respect to FIG. 7. In combination with end coupling cell piece 70, the coupling cell piece 66 provides the necessary coupling cell shape to effect transmission of RF energy from the first cavity arm 24 to the second cavity arm 26. In the present embodiment, the coupling cell has a racetrack shape. The dimensional parameters of the coupling cell, given in Table 3 below, provide the further advantage that the coupling cell strongly couples the fundamental mode, but weakly couples higher order modes.

Figure 5:
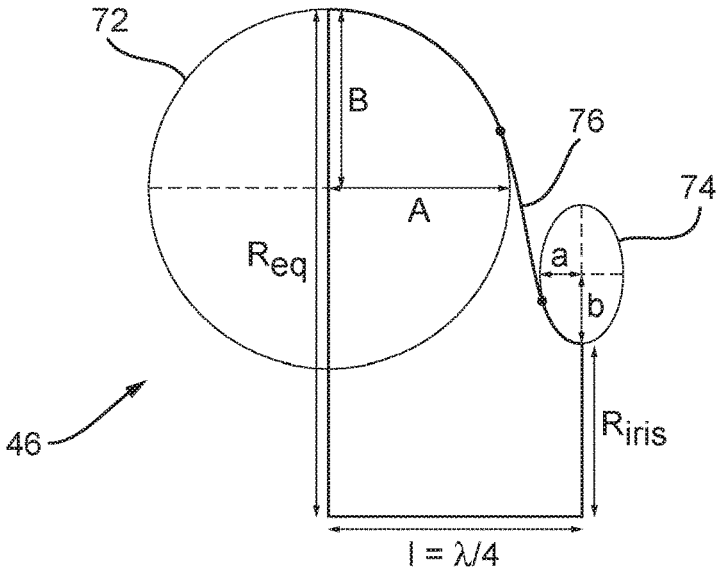
FIG. 5 shows an outline of a quadrant of a mid-cell of the second cavity arm of the embodiment of FIG. 2, showing first and second ellipses that define the curvature of the cell profile.

FIG. 5 shows the outline of a cross-sectional view of the quadrant 46 shown in FIG. 3, overlaid with a first ellipse 72 and a second ellipse 74 which define the curvature of the outer profile 76 of the cell quadrant. The curvature of the outer cell profile 76 is specified according to the major and minor axes of the first and second ellipses 72, 74. The first ellipse 72 has minor axis A and major axis B. Second ellipse has minor axis a and major axis b. The dimension of the cell quadrant in the axial direction (i.e. along the axis 30 shown in FIG. 2) is $l=\lambda/4$, where $\lambda$ is the wavelength of the fundamental mode of each mid-cell 36. The radius of the mid-cell piece 46 at its widest point is specified as $R_{eq}$. The radius of the mid-cell piece at its narrowest point is $R_{iris}$.

TABLE 1

| Parameter | Symmetric (both arms' cells)/mm | Asymmetric (first cavity arm cells)/mm | Asymmetric (second cavity arm cells)/mm |
|---|---|---|---|
| $R_{eq}$ | 103.3 | 103.3 | 104.3 |
| A | 42 | 42 | 42 |
| B | 42 | 42 | 43.1 |
| $R_{iris}$ | 35 | 35.75 | 37 |
| a | 12 | 12.75 | 11.75 |
| b | 19 | 18 | 20 |
| l | 57.7 | 57.7 | 57.7 |

Table 1 shows three sets of example values for the parameters $R_{eq}$, A, B, $R_{iris}$, a, b and 1. The first column of values is a typical set for a mid-cell 12, 16 of a symmetric cavity apparatus according to FIG. 1, i.e. the prior art. This set of parameters applies to the mid-cells 12, 16 in both the first cavity arm 4 and the second cavity arm 6. The second column of values (first cavity arm calls) is an example set of values for the parameters of a mid-cell 32 of the first cavity arm 24 of the asymmetric cavity apparatus of FIG. 2. These values would be used in combination with the values of the third column (second cavity arm cells), which are the corresponding parameter values for the mid-cells 36 of the second cavity arm 24 of FIG. 2.

The end cell piece 58 and the mid-to-coupling cell piece 68 have dimensional parameters $R_{eq}$, A, B, $R_{iris}$, a, b and 1 corresponding to the equivalent parameters of the mid-cells 32. Table 2 shows the parameter values for the cell piece 58 and the mid-to-coupling cell piece 68 of the embodiment of FIG. 2.

TABLE 2

| Parameter | First cavity arm end cell piece/mm | Second cavity arm end cell piece/mm | First cavity arm mid-to-coupling-cell piece/mm | Second cavity arm mid-to-coupling cell piece/mm |
|---|---|---|---|---|
| $R_{eq}$ | 103.3 | 104.3 | 103.3 | 104.3 |
| A | 42 | 42 | 42 | 42 |
| B | 42 | 43 | 43.4 | 43.5 |
| $R_{iris}$ | 39 | 39 | 35 | 35 |
| a | 12.75 | 11.75 | 12.75 | 9.69 |
| b | 18 | 20 | 18 | 20 |
| l | 58.54 | 60.96 | 57.7 | 57.7 |

Figure 6:
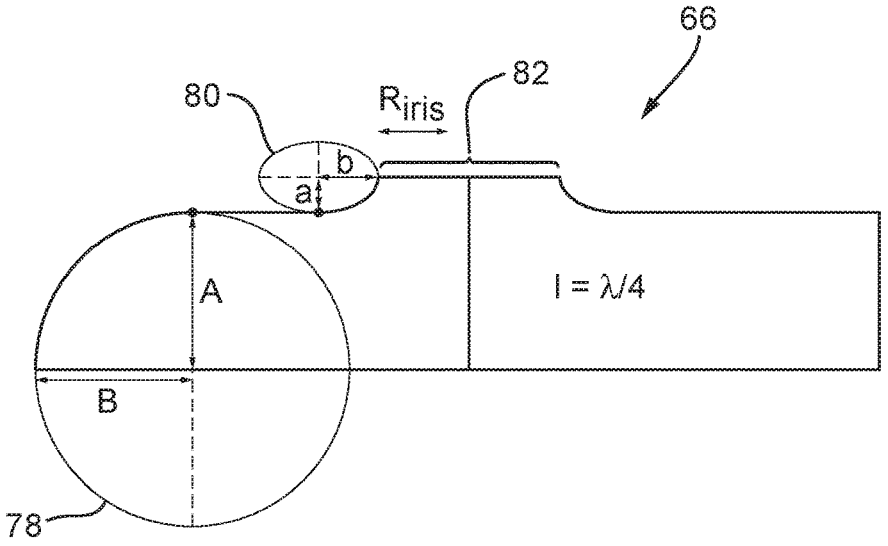
FIG. 6 shows a side view of a mid-to-coupling cell, showing first and second ellipses that define the curvature of the profile of the half-cell.
Figure 7:
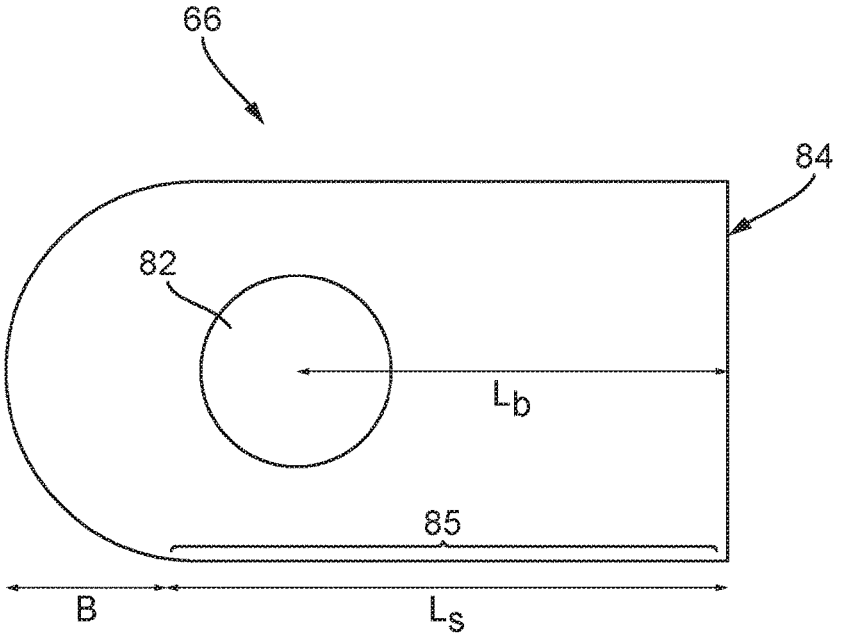
FIG. 7 shows a top view of the mid-to-coupling cell shown in FIG. 6.

FIGS. 6 and 7 show the coupling cell piece 66 of the coupling cell 40 of the cavity apparatus 22 of FIG. 2. A corresponding piece having the same shape and dimensions is provided for the first cavity arm 24. FIG. 6 shows an outline of a side cross-section of the coupling cell piece 66, showing various parameters that define the shape of the coupling cell piece 66. First and second ellipses 78, 80, overlaid on the cross-section profile define the curvature of the coupling cell piece 66. The first ellipse 78 has minor axis A and major axis B. The second ellipse 80 has minor axis a, and major axis b. The maximum dimension of the coupling cell piece 66 in the axial direction (i.e. the direction of the cavity arm axis of rotation symmetry) is $l=\lambda/4$, where $\lambda$ is the wavelength of the fundamental mode of the cells of the cavity arm. A circular hole 82 is provided where the coupling cell piece 66 joins to the adjacent mid-cell piece 68. The circular hole 82 has radius $R_{iris}$.

FIG. 7 shows a top view of the coupling cell piece 66. The coupling cell piece 66 is shaped to be joined to a corresponding coupling cell piece for the first cavity arm 24 at one end 84. The coupling cell pieces, in combination with end coupling cell pieces (described below with reference to FIG. 8), thus form a single coupling cell having a racetrack shape. The coupling cell piece 66 has dimensional parameter $L_b$, the distance from the end 84 to the center of the circular hole 82. The coupling cell piece 66 also has a parameter $L_s$, which is the length of the straight side 85 of the coupling cell piece 66.

Figure 8:
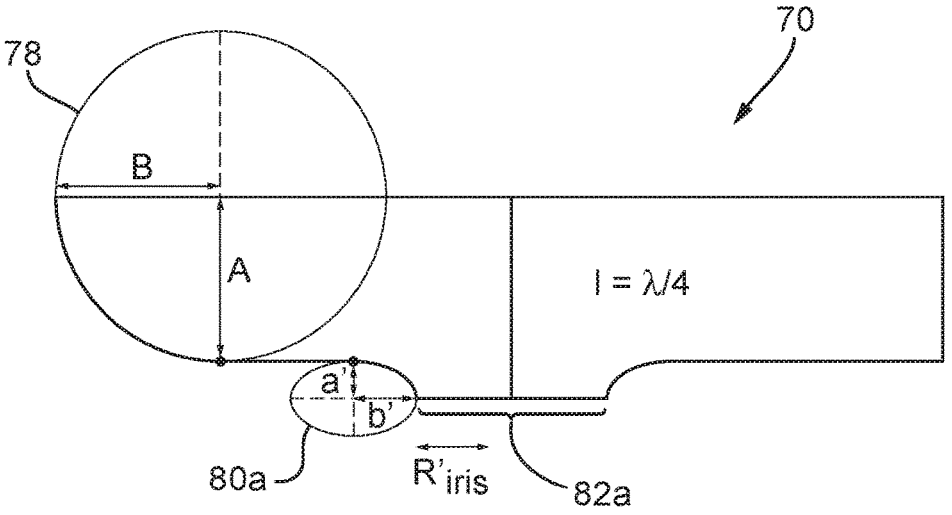
FIG. 8 shows a side view of an end coupling cell.

A cross-section of end coupling cell piece 70, corresponding to coupling cell piece 66, is shown in FIG. 8. The end coupling cell piece 70 also has curvature defined by the first ellipse 78. It has an opening 82*a*, equivalent to the opening 82 of the coupling cell piece 66. The size and shape of the opening 82*a* is defined by a third ellipse 80*a*, and equivalent parameters a', b' and $R'_{iris}$, as depicted in FIG. 8.

Typical values for the dimensional parameters of the coupling cell piece 66 and the end coupling cell piece 70 are shown in Table 3.

TABLE 3

| Parameter | Coupling cell piece/mm | End coupling cell piece/mm |
|---|---|---|
| A | 48.052 | 47.5 |
| B | 29 | 29.76 |
| $R_{iris}$ | 35 | 39 |
| a | 9.6 | 9.945 |
| b | 10.152 | 9.945 |
| l | 57.652 | 57.652 |
| $L_s$ | 150 | 150 |
| $L_b$ | 111 | 111 |

Figure 9:
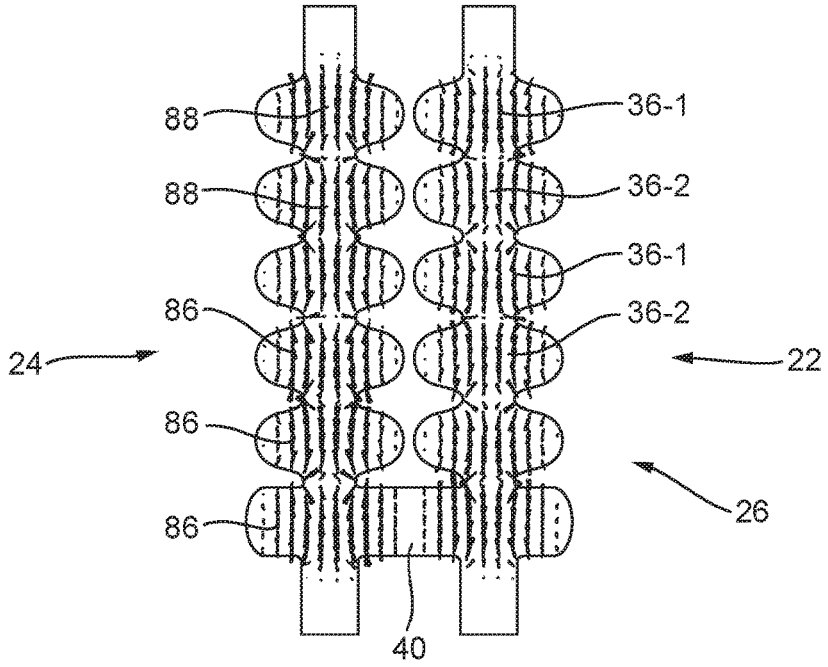
FIG. 9 shows the cavity apparatus of FIG. 2, overlaid with vector arrows indicating the strength and direction of the electric field of the fundamental mode of the cavity.

FIG. 9 shows the cavity apparatus 22 of FIG. 2, overlaid with vector arrows 86 which indicate the magnitude and direction of an electric field of the fundamental mode of the cavity cells when a standing electromagnetic wave is generated in the cavity apparatus. The fundamental mode corresponds to an accelerating mode or operating mode, i.e. the mode which is used to accelerate or decelerate the electrons along the axis of the cavity arms 24, 26. It can be seen from FIG. 9 that the electric field at the center 88 of each cell is in the axial direction. It can also be seen that the direction of the electric field alternates with each cell, i.e. cells 36-1 have the electric fields directed away from the coupling call 40, and cells 36-2 have the electric fields directed towards the coupling cell 40. This is because the center of each cell corresponds to an anti-node of the standing wave. As the standing wave oscillates, the direction of the electric fields in each cell will alternate such that it changes direction twice each period.

When the device is under operation, electrons are sent along the axis of each cavity arm in bunches, at such a velocity so as to coincide their passage through the center of each cell with the occurrence of a maximum in the anti-node, i.e. to coincide with when the electric field is strongest and is pointing in the direction that the electrons are moving (or, where the electrons are being decelerated, in the opposite direction). It can be seen from FIG. 9 that the magnitude of the electric field of the first cavity arm is substantially equal to the magnitude of the electric field in the second cavity arm, i.e. the first and second cavity arms share a common fundamental (i.e. accelerating or operating) mode.

Figure 10:
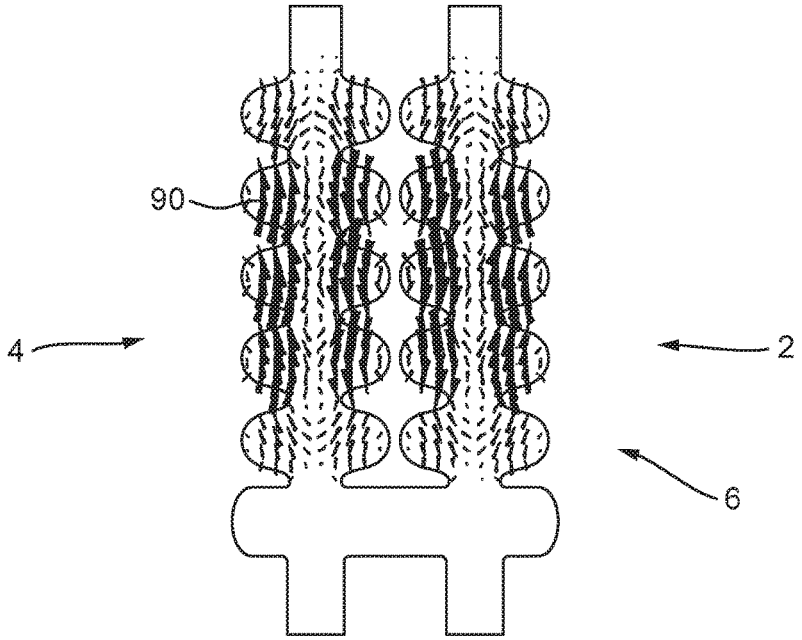
FIG. 10 shows the cavity apparatus of the prior art as shown in FIG. 1, overlaid with vector arrows indicating the strength and direction of the electric field of a higher order mode of the cavity.

FIG. 10 shows the cavity apparatus of FIG. 1, i.e. of the prior art, with vector arrows overlaid thereon showing the electric field of a higher order mode. The vector arrows 90 show that the electric field is low near the axis of each cavity arm and higher away from the axis. The effect of such high order modes on the trajectory of the electron bunches moving through the cavity arm will depend on the particular mode, e.g. whether it is a monopole, dipole, quadrupole or higher order mode. The higher order modes (or parasitic modes) have the effect of interfering with the desired trajectory of the electron bunches, and may cause the bunches to lose integrity (i.e. to break apart), particularly at high currents when the amount of charge in each bunch is higher. This limits the operating current of the cavity, and thus limits the brightness of the X-rays (or other radiation) that could be generated using the accelerated electron beam. As the cells of each cavity arm have equal dimensional parameters, the higher order mode is of equal magnitude in each arm.

Figure 11:
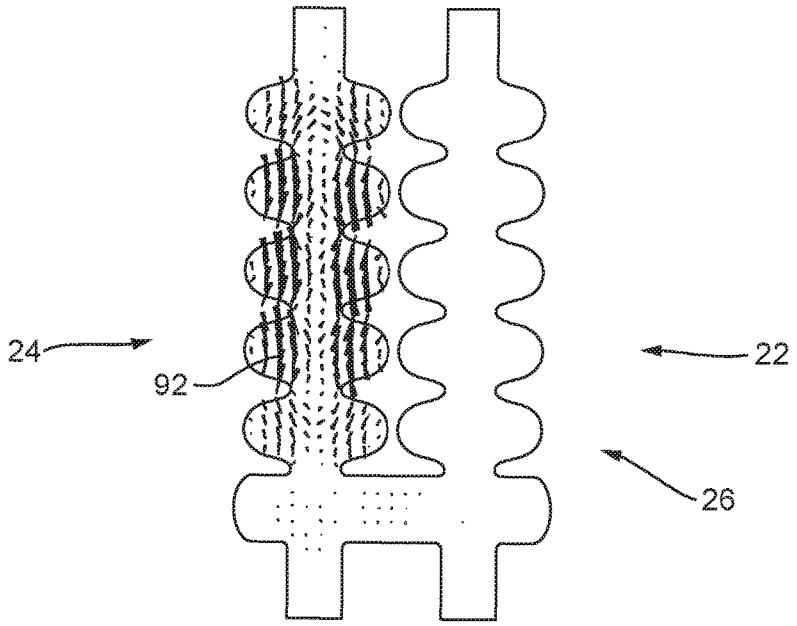
FIG. 11 shows the cavity apparatus of FIG. 2, overlaid with vector arrows indicating the strength and direction of the electric field of the higher order mode shown in FIG. 10.

FIG. 11 shows the cavity apparatus 22 according to FIG. 2 with vector arrows 92 overlaid thereon. The vector arrows correspond to the same higher order mode as is depicted in FIG. 10. However, the cells of the second cavity arm 26 are different from the cells of the first cavity arm 24 the second cavity arm, which prevents constructive interference of the higher order mode to establish a standing wave at that frequency. Accordingly, the higher order mode is suppressed. The result is that while the electric field of the higher order mode is present in the first cavity arm 24, no electric field corresponding to that mode is seen in the second cavity arm 26. It will be understood that besides the mode represented in FIG. 11, there are other higher order modes that are present in the second cavity arm 26 but not present in the first cavity arm 24. Similarly, there are higher order modes that are present in the first cavity arm 24 which are not present in the second cavity arm 26.

Accordingly, when electron bunches are decelerated in the one cavity arm, e.g. the first cavity arm 24, if some of the electrons' energy is transferred to the higher order mode shown in FIG. 11, this energy is not transferred to a corresponding higher order mode in the other cavity arm, e.g. the second cavity arm 26. There is therefore no increase in deflections of electrons in the second cavity arm 26 as a result of energy being transferred from the decelerating electrons to the higher order mode shown in FIG. 11.

As a result, the electrons can be accelerated with significantly reduced interference from the parasitic modes. This allows higher currents to be used without causing break-up of the electron bunches. Thus, higher energy electron beams and brighter X-rays can be generated.

Figure 12:
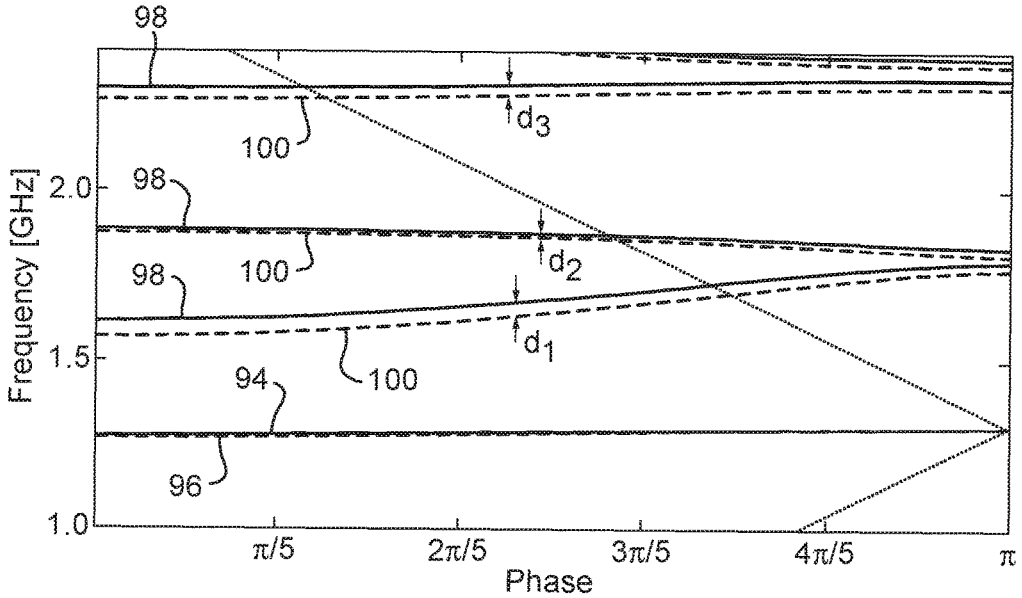
FIG. 12 shows a dispersion diagram for two cell designs according to embodiments of the invention, where the dispersion diagram shows the path bands for the fundamental and higher order modes for each cell design.

FIG. 12 shows a dispersion diagram illustrating the frequency pass-bands for a mid-cell of the first cavity arm 24 (solid lines) and the mid-cells of the second cavity arm 26 (dashed lines). The solid lines correspond to a mid-cell having the parameters of the axis 1 cell of Table 1. The dashed lines correspond to a mid-cell having the parameters of the axis 2 cell of Table 1.

Each line on the dispersion diagram represents the pass-band for a particular mode in the case of an infinitely periodic structure, i.e. using a model which ignores the effects of having a finite number of mid-cells. A pass-band shows the frequency range in which a mode can propagate with a particular phase advance between adjacent cells in a cavity arm. The phase advance between adjacent cells of the cavity arm is the quantity shown on the x-axis of the dispersion diagram. The frequency of the mode in GHz is shown on the y-axis.

The lowest frequency solid line 94 of the first cavity arm cells and the lowest frequency dashed line 96 of the second cavity arm cells correspond to the fundamental mode (the operating or accelerating mode) of the respective cavity arms 24, 26. The two fundamental modes 94, 96 of the respective cavity arms 24, 26 show very little difference in frequency, indicating that the cells of the first and second cavity arms 24, 26, for practical purposes, may be considered to share the same fundamental mode.

The higher order modes of the first cavity arm 24 are indicated by solid lines 98. The higher order modes of the second cavity arm 26 are indicated by dashed lines 100. The difference in the parameters of the cells of the first and second cavity arms 24, 26 results in a difference in frequency of corresponding pass-bands. The difference in the frequency of these pass-bands prevents the higher order modes of the first cavity arm occurring in the second cavity aim (and vice versa), in particular, due to weak coupling, via the coupling cell, of eigenmodes which are not simultaneously shared by the cavities at both arms. The difference between each pair of higher order modes is shown as $d_1$ for the lowest frequency pair, $d_2$ for the next highest, and $d_3$ for the next highest. It is preferable that the difference $d_1$, $d_2$, $d_3$ between each pair of adjacent pass-bands is of the order of MHz, as provides a desirable level of suppression of the higher order modes in the second cavity arm.

Figure 13:
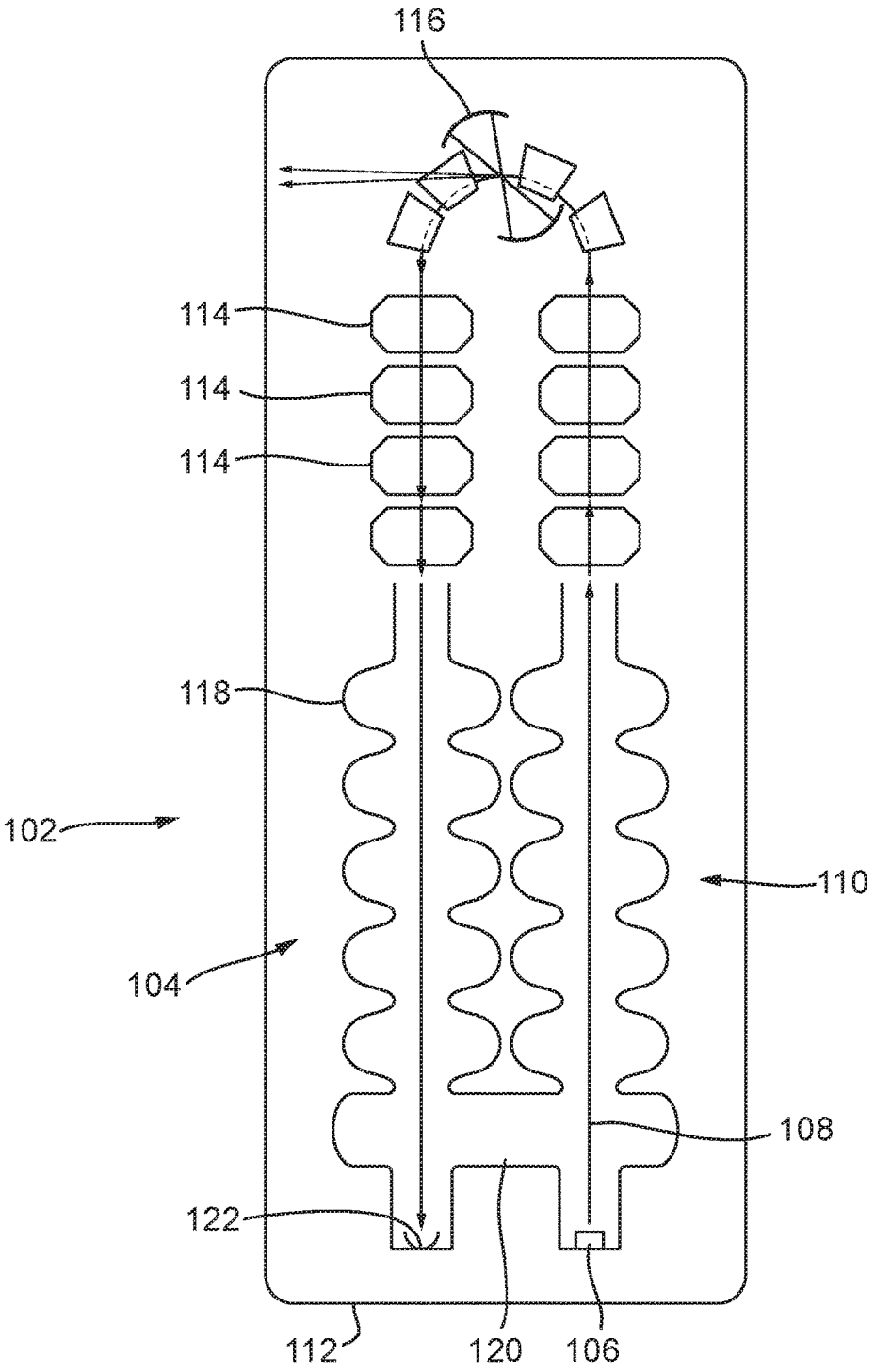
FIG. 13 shows the cavity apparatus of FIG. 2 in operation with an electron beam accelerated by the cavity apparatus and used to generate X-rays through inverse-Compton scattering.

FIG. 13 shows an exemplary X-ray generation apparatus 102 comprising a cavity apparatus 104 of the construction described with respect to FIG. 2. The cavity apparatus 104 is embedded in a cryostat 112. The cavity apparatus comprises super-conducting material. The apparatus comprises an electron beam generator 106 which generates an electron beam 108. The electron beam 108 is accelerated along the second cavity arm 110. An array 114 of super-conducting magnets is embedded in the same cryostat 112 as the cavity apparatus 104. The array 114 of super-conducting magnets is used to transport, focus and compress the electron beam 108. As is shown, the electron beam 108 may pass through a laser near a cavity 116 where it interacts with photons to generate X-rays via inverse Compton scattering. After the electron beam 108 has interacted with the photons, it is re-directed by the super-conducting magnet array 114 to the first cavity arm 118 where it is decelerated. The RF energy recovered from the deceleration of the electron beam 108 is transmitted to the second cavity arm 110 via RF transmission means in the form of a coupling cell 120 so that the RF energy can be used for the acceleration of the electrons in the second cavity arm 110. The decelerated electrons 108 are then directed into a beam dump 122. A significant fraction of the energy of the electron beam 108 is recovered when it is decelerated in the first cavity arm 104, making the apparatus more efficient. The electron beam, after deceleration, is dumped at much lower energy than its maximum energy. For example, the energy at the dump may be of the order of 200 times less than the maximum beam energy. Correspondingly, the RF power to accelerate the electron beam is about 200 times lower than the reactive power of the electron beam at the point of interaction with the laser light.

In the embodiment of FIG. 13, the electron beam 108 is accelerated in the second cavity arm 110 and decelerated in the first cavity arm 118. However, it will be appreciated that with suitable repositioning of the electron beam generator 106 and the beam dump 122, the electron beam 108 could be directed in the opposite direction, i.e. accelerated in the first cavity arm 118 and decelerated in the second cavity arm 110.

The electron beam 108 comprises bunches of electrons. The suppression of the higher order modes in the second cavity arm allows the acceleration of electron bunches of greater charge, i.e. allowing higher operating current. Accordingly, brighter X-ray beams can be generated.

It will be appreciated that only one particular embodiment of the cavity apparatus of the present invention has been described above, with one example application. Many other embodiments, variations and applications are possible within the scope of the invention.

What is claimed is:

1. A radio-frequency (RF) cavity apparatus for accelerating charged particles, comprising:

first and second cavity arms, the first and second cavity arms having respective first and second axes of rotational symmetry and each cavity arm comprising at least one cell, wherein the first and second cavity arms are connected by a resonance coupler, wherein the cell(s) of the first cavity arm have an axial dimensional parameter that is equal to a corresponding axial dimensional parameter of the cell(s) of the second cavity arm, and wherein the cell(s) of the first cavity arm have at least one non-axial dimensional parameter that differs from corresponding non-axial dimensional parameter(s) of the cell(s) of the second cavity arm.

2. The cavity apparatus as claimed in claim 1, wherein more than one non-axial dimensional parameter differs between the cell(s) of the first and second cavity arms.

3. The cavity apparatus as claimed in claim 1, wherein the or each non-axial parameter is selected from a group consisting of: a maximum width of a cell; a maximum radius of a cell; a minimum width of a cell; a minimum radius of a cell; and a curvature of a cell wall.

4. The cavity apparatus as claimed in claim 1, wherein the non-axial dimensional parameter(s) are one or more of the major and minor axes of one or more ellipses, where the ellipses correspond to portions of a cavity wall along an axial cross-section of a cell.

5. The cavity apparatus as claimed claim 1, wherein the difference between the or each of the non-axial dimensional parameters of the cell(s) of the first cavity arm and the corresponding non-axial dimensional parameter(s) of the cell(s) of the second cavity arm, expressed as a percentage of the former, is less than about 5%, preferably less than about 3%, more preferably less than about 1%, and most preferably less than about 0.5%.

6. The cavity apparatus as claimed in claim 1, wherein the axial dimensional parameter is the length of each cell.

7. The cavity apparatus as claimed in claim 1, wherein the axial dimensional parameter value of the cell(s) of the first and second cavity arms is selected so as to support a fundamental mode in the range of about 100 MHz-10 GHz, preferably about 500 MHz-5 GHz, more preferably about 1-2.5 GHz, and most preferably about 1.3 GHz.

8. The cavity apparatus as claimed in claim 1, wherein the resonance coupler is configured to strongly couple eigenmodes which have the same frequencies and to weakly couple eigenmodes which have different frequencies.

9. The cavity apparatus as claimed in claim 1, wherein the resonance coupler comprises a single coupling cell which is connected to one end of each of the cavity arms.

10. The cavity apparatus as claimed in claim 9, wherein the single coupling cell is racetrack- or oblong-shaped.

11. A method of recovering energy from a charged particle beam comprising:

generating a charged particle beam;

passing the charged particle beam through a first cavity arm of a radio-frequency (RF) cavity apparatus, the first cavity arm being arranged to apply an electric and/or magnetic field to accelerate the charged particle beam;

passing the charged particle beam through a second cavity arm of the radio-frequency (RF) cavity apparatus, the second cavity arm being arranged to apply an electric and/or magnetic field to decelerate the charged particle beam after it has interacted;

wherein the first and second cavity arms are connected by a resonance coupler, wherein the cell(s) of the first cavity arm have an axial dimensional parameter that is equal to a corresponding axial dimensional parameter of the cell(s) of the second cavity arm, and wherein the cell(s) of the first cavity arm have at least one non-axial dimensional parameter that differs from corresponding non-axial dimensional parameter(s) of the cell(s) of the second cavity arm.

12. The method as claimed in claim 11, wherein more than one non-axial dimensional parameter differs between the cell(s) of the first and second cavity arms.

13. The method as claimed in claim 11, wherein the or each non-axial parameter is selected from a group consisting of: a maximum width of a cell; a maximum radius of a cell; a minimum width of a cell; a minimum radius of a cell; and a curvature of a cell wall.

14. The method as claimed in claim 11, wherein the non-axial dimensional parameter(s) are one or more of the major and minor axes of one or more ellipses, where the ellipses correspond to portions of a cavity wall along an axial cross-section of a cell.

15. The method as claimed in claim 11, wherein the difference between the or each of the non-axial dimensional parameters of the cell(s) of the first cavity arm and the corresponding non-axial dimensional parameter(s) of the cell(s) of the second cavity arm, expressed as a percentage of the former, is less than about 5%, preferably less than about 3%, more preferably less than about 1%, and most preferably less than about 0.5%.

16. The method as claimed in claim 11, wherein the axial dimensional parameter is the length of each cell.

17. The method as claimed in claim 11, wherein the axial dimensional parameter value of the cell(s) of the first and second cavity arms is selected so as to support a fundamental mode in the range of about 100 MHz-10 GHz, preferably about 500 MHz-5 GHz, more preferably about 1-2.5 GHz, and most preferably about 1.3 GHz.

18. The method as claimed in claim 11, wherein the resonance coupler comprises a single coupling cell which is connected to one end of each of the cavity arms.

19. The method as claimed in claim 18, wherein the single coupling cell is racetrack- or oblong-shaped.

20. The method as claimed in claim 11, wherein the resonance coupler is configured to strongly couple eigenmodes which have the same frequencies and to weakly couple eigenmodes which have different frequencies.

* * * * *